US008505754B2

(12) United States Patent
Morath

(10) Patent No.: US 8,505,754 B2
(45) Date of Patent: Aug. 13, 2013

(54) CRANE, PREFERABLY CRAWLER OR TRUCK CRANE

(75) Inventor: Erwin Morath, Ehingen/Donau (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 1441 days.

(21) Appl. No.: 11/490,718

(22) Filed: Jul. 20, 2006

(65) Prior Publication Data

US 2007/0034587 A1 Feb. 15, 2007

(30) Foreign Application Priority Data

Jul. 22, 2005 (DE) ..... 10 2005 034 333
Aug. 1, 2005 (DE) ..... 10 2005 036 058
Dec. 14, 2005 (DE) ..... 10 2005 059 768

(51) Int. Cl.
*B66C 13/48* (2006.01)
*B66C 13/18* (2006.01)

(52) U.S. Cl.
USPC ..... 212/286; 212/276; 212/284

(58) Field of Classification Search
None
See application file for complete search history.

(56) References Cited

U.S. PATENT DOCUMENTS 5,731,974 A * 3/1998 Pietzsch et al. ..... 700/83
2004/0133327 A1 * 7/2004 Ishimoto et al. ..... 701/50
2005/0098520 A1 5/2005 Frankenberger et al.

FOREIGN PATENT DOCUMENTS

DE 44 17 608 8/1995
DE 196 12 423 A1 * 10/1997
DE 100 23 418 11/2001
DE 102 33 870 2/2004
DE 102 33 873 2/2004
EP 0768588 4/1997

OTHER PUBLICATIONS

English translation of DE 196 12 423 A1; the Rudnik reference.*
Cohrs, Load Moment Limiter and Crane Electronics, *F+H Fördern und Heben 39*, Nr. 12, pp. 1008-1010, 1989.

* cited by examiner

*Primary Examiner* — Emmanuel M Marcelo
*Assistant Examiner* — Justin Stefanon
(74) *Attorney, Agent, or Firm* — Alleman Hall McCoy Russell & Tuttle LLP

(57) ABSTRACT

The present disclosure relates to a crane, preferably a crawler or truck crane, comprising a crane monitoring means for monitoring the operating condition of the crane, including a calculation unit and a control and display unit. In accordance with the present disclosure, there is additionally provided an operations planner with a separate monitor output, which includes a further calculation unit and which operates on the one hand as a device for planning the operation of the crane and on the other hand as a redundant crane monitoring unit in addition to the crane monitoring means.

19 Claims, 1 Drawing Sheet

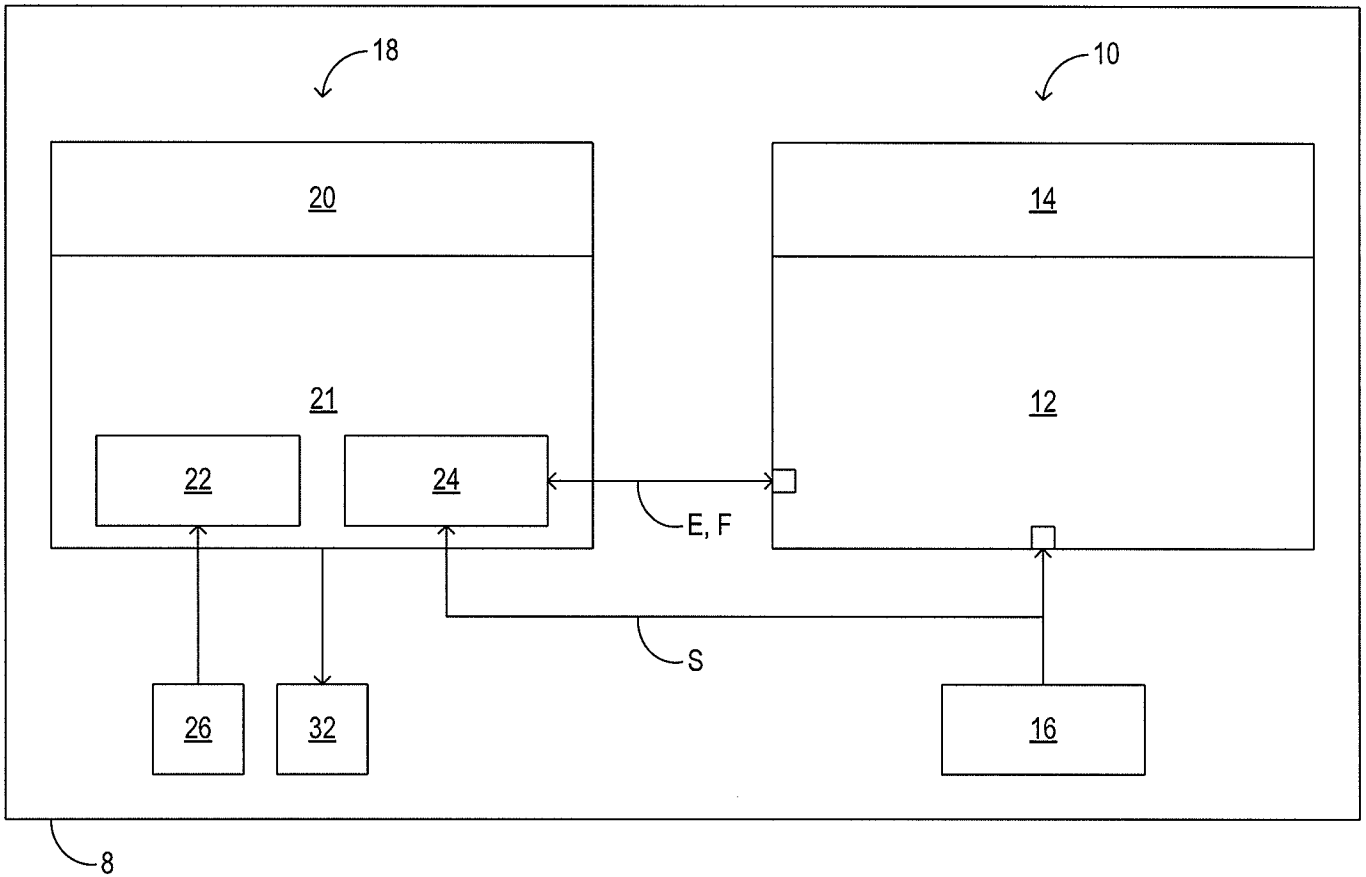
10
14
12
16
E, F
S
18
20
21
24
22
32
26
8

CRANE, PREFERABLY CRAWLER OR TRUCK CRANE

CROSS-REFERENCE TO RELATED APPLICATION

This application claims priority to German Patent Application Serial No. 10 2005 034 333.3 filed Jul. 22, 2005, German Patent Application Serial No. 10 2005 036 058.0 filed Aug. 1, 2005, and German Patent Application Serial No. 10 2005 059 768.8 filed Dec. 14, 2005, all of which are hereby incorporated by reference in their entirety for all purposes.

FIELD

The present disclosure relates to a crane, preferably a crawler or truck crane.

BACKGROUND AND SUMMARY

Truck cranes and crawler cranes are known in different sizes and set-ups. In order to select the proper crane with the set-up appropriate for the task to be solved and the crane provided with the proper ballast weight for a specific use of a crane, it is known already to use an operations planner. Such crane operations planner is a computer program for planning, simulating and documenting crane operations on a personal computer. Upon receipt of an order, the same is planned in detail by means of the operations planner. This planning performed and documented in advance will then be processed during operation.

It is furthermore known to equip a crane with a crane monitoring means (e.g. load moment limitation, overload limitation, working range limitation, power limitation) for monitoring the operating condition of the crane. Such crane monitoring means substantially includes one or more calculation systems and at least one display unit. Sensor signals detected via sensors provided at the crane, such as detected angles, lengths or weights, are input into the computer system. On the basis of correspondingly stored comparative values, the crane monitoring means then determines whether the crane is overloaded or is used within the permitted working range. However, the known crane monitoring means only is provided with a single channel and can fail.

It is the object of the present disclosure to improve the safety of the crane monitoring system and in addition increase the operational convenience for the crane operator.

In accordance with the present disclosure, this object is solved by a crane, preferably a crawler or truck crane, that first of all includes a crane monitoring means for monitoring the operating condition of the crane, which includes one or more computer systems and at least one display unit. In accordance with the present disclosure, there is additionally provided an operations planner, which includes one or more computer systems and at least one separate monitor output. This operations planner on the one hand operates as a device for planning the operation of the crane and on the other hand as a redundant crane monitoring unit in addition to the crane monitoring means. In the present case, the operations planner, which as such is used stationarily, has been incorporated into the crane as a component thereof. This leads to the fact that the crane operator has the operations planner directly available on the site and thus can plan the corresponding crane operation in detail in advance.

In accordance with the present disclosure, the operations planner is not only used here as a device for planning the operation of the crane. It is also used as a redundant crane monitoring unit, in that corresponding sensor values are input here, which were detected by sensors distributed over the crane. Said sensor values constitute input values for calculation programs stored in the operations planner, by means of which the current operating data and limit values of the crane are recalculated. There is thus created a diverse and hence independent parallel monitoring instrument, which leads to the fact that the crane of the present disclosure includes an independent multi-channel monitoring system.

Accordingly, it is particularly advantageous when both the crane monitoring means and the operations planner each have separate display units. The same can then be checked by a crane operator simultaneously at one sight, without having to switch the screen contents.

Advantageously, the display unit of the operations planner can always be switchable between the display of the device for planning the crane operation and the crane monitoring unit, the current crane position being taken over. Before operating the crane, the crane operator will usually operate the display unit in that mode in which he can check the planning of the crane operation. When operating the crane, he can then switch the display unit into the mode of the redundant crane monitoring, so that here he can overlook both the display of the crane monitoring means and the display of the redundant crane monitoring unit in parallel.

Advantageously, the crane includes at least one comparator unit, which compares the crane operation values determined independently in the operations planner on the one hand and in the crane monitoring means on the other hand, and upon occurrence of an unacceptable deviation generates an error message (e.g. optical and/or acoustic warning signal) and/or influences the crane control such that the crane is maintained in a safe condition or reaches a safe condition (safety shut-off).

The operations planner and the crane monitoring means can interchange data and temporary results, e.g. for the further calculation, display and monitoring.

As a device for planning the operation of the crane, the operations planner advantageously can include a load capacity program for calculating the load capacity, a configuration selection program for selecting suitable crane configurations (such as boom length, ballast, supporting base, range of rotation, ballast radius, additional equipment), a ballast determination program for determining the minimum and maximum derrick ballast to be used in dependence on the type of crane, a planning program for simulating the planned operation of the crane (i.e. change of operating parameters such as angle of boom and accessories, boom length, ballast, derrick ballast, derrick ballast radius), a supporting force calculation program for determining the forces acting on the supports, a crawler pressure program for determining the ground pressures occurring at the crawlers, and an anti-collision means for avoiding collisions of several cranes operating in combination.

As a redundant crane monitoring unit, the operations planner can execute the included programs described above based on data for the adjusted current crane setting values, which are stored in its memory, and for the current crane sensor values detected by various sensors.

Particularly advantageously, the current crane condition can be displayed on an output monitor. The graphical representation of the crane monitoring means or the redundant crane monitoring unit includes two-dimensional or three-dimensional views. The following features exist:

The dimensions of the crane (e.g. supporting base, boom length) are approximately or exactly true to scale.

In the chart, the movable components of the crane, such as rotary platform, boom, luffing tip, are moving in the mode of the crane monitoring unit due to the information from the sensors and in the mode of the operations planner approximately as in reality due to the inputs from the control unit.

Like in the operations planner, the graphical representation can be enlarged or reduced on the personal computer by zooming or can be varied by shifting the image area. Furthermore, by drawing buildings or other obstacles, a construction site can be represented, or the representation of the construction site illustrated before in the mode of the operations planner can be taken over. Moreover, information as to length and distance between displayed items within the working range of the crane can be obtained by means of measurements.

In the graphical display, the load capacity can be indicated in dependence on the outreach. In the graphical display in the mode of the operations planner for derrick cranes, the outreach and the respective derrick ballast radius or also the load capacity and the respective derrick ballast radius can be indicated.

BRIEF DESCRIPTION OF THE FIGURES

Further details and advantages of the present disclosure will be explained in detail with reference to an embodiment as shown in the drawing.

FIG. 1 schematically shows the interconnection of the operations planner on the one hand and the crane monitoring means on the other hand.

DETAILED DESCRIPTION

In the illustrated embodiment, a crane 8, such as a crawler crane or a truck crane, includes a crane monitoring means 10 which on the one hand includes a calculation unit 12 and a monitor 14. Sensor signals S, such as angle, length, weights, etc., which are detected by sensors 16 provided at the crane 8, are input into said crane monitoring means 10. On the basis of these measured values, the admissible working range and the load limit values of the crane 8 (not illustrated here in further detail) are monitored with reference to values stored in the memory, such as crane-specific load capacity tables in dependence on set-up and reeving.

Parallel to the crane monitoring means 10 previously installed in the crane 8, there is now provided an operations planner 18, which likewise includes a separate monitor 20 and a computer 21 with two functions. The first function is indicated by the reference numeral 22 and relates to the known function as operations planner. Here, all operations planner functions are performed, which so far could already be calculated centrally by an operations planner on a personal computer. The operation is effected e.g. via a mouse 26 or a keyboard (e.g. touch screen) of the monitor 20 (not illustrated in detail). This function is completely independent of the second function, namely the redundant crane monitoring 24. In the case of the redundant crane monitoring, sensor values S from the sensors 16 provided at the crane 8 are input into the computer unit 21. Furthermore, corresponding setting values E from the crane monitoring means 10 are provided to the redundant crane monitoring 24, which setting values concern for instance the operating mode, the reeving or other set values of the crane. Accordingly, these are data which the crane operator has set at the crane monitor or which are supplied via sensors (e.g.: ballast components, supporting base, boom configuration). In addition, further data F and temporary results can be interchanged between operations planner and crane monitoring system.

In the redundant crane monitoring 24, the current setting values and the current crane sensor values are evaluated and parallel to and independent of the crane monitoring means, the current operating parameters and monitoring limit values are calculated by means of load capacity values and geometry files stored separately in the operations planner 18.

These calculation results include in particular the maximum load capacity and for instance the current outreach and the entire current geometry and determination of the center of gravity/kinematics.

The independently obtained calculation results of the operations planner 18 on the one hand and the crane monitoring means 10 on the other hand are compared in at least one computer, and in the case of an unacceptable deviation of the respective results an error signal is provided, which can be processed directly in the crane control 32, in order to prevent e.g. dangerous movements and additionally trigger an alarm.

Advantageously, all commonly used graphical representations of the operations planner on the personal computer can be displayed on the monitor 20 of the operations planner 18, wherein the data and graphical images can be represented for the respective current crane condition, as all current sensor values and other data are provided to the operations planner 18.

This means that in the case of a movement of the crane, the chart of the operations planner monitor 20 will also move corresponding to the current crane position. Here, graphical images can, for instance, illustrate various views. In the case of a crawler crane, the crawler pressure can also be illustrated dynamically, whereas in the case of a crane with supports, the occurring supporting forces can each be illustrated.

The invention claimed is:

1. A system comprising:

a crane;

a sensor coupled in the crane and configured to detect an operating condition of the crane;

a crane monitoring means incorporated in the crane, operatively coupled to the sensor, and configured for monitoring the operating condition of the crane, the crane monitoring means including a calculation unit and a first display unit; and an operations planner incorporated in the crane, operatively coupled to the sensor, configured for planning an operation of the crane and for redundantly monitoring the operating condition of the crane in dependence on the sensor, the operations planner including a computer and a second display unit.

2. The system of claim 1, wherein the first display unit and the second display unit are separate from each other and arranged within sight of an operator of the crane.

3. The system of claim 2, wherein the second display unit is configured to switch between a display for planning the operation of the crane and a display for monitoring the operating condition of the crane.

4. The system of claim 1, wherein at least one of the computer and the calculating unit is configured to compare crane operation values determined independently in the operations planner and in the crane monitoring means and to generate an error message when the crane operation values deviate unacceptably.

5. The system of claim 1, wherein at least one of the computer and the calculating unit is configured to compare crane operation values determined independently in the operations planner and in the crane monitoring means and to influence a crane control such that the crane is maintained in a safe condition or reaches a safe condition when the crane operation values deviate unacceptably.

6. The system of claim 1, wherein the operations planner, operating to plan an operation of the crane, is configured for each of computing load capacity, enabling configuration selection, determining ballast, simulating planned operation of the crane, computing supporting force, and computing crawler pressure.

7. The system of claim 1, wherein the operations planner, operating to redundantly monitor an operation of the crane, is configured for each of computing maximum admissible load capacity, and maximum possible outreach based at least partly on stored data and at least partly on one or more crane sensor values.

8. The system of claim 1, further configured to graphically represent a current crane condition true to scale on one or more of the first display unit and the second display unit for various set-up variants.

9. The system of claim 1, wherein the crane is a crawler crane.

10. The system of claim 1, wherein the crane is disposed on a truck.

11. The system of claim 1, wherein one or more setting values from the crane monitoring means are provided to the computer of the operations planner.

12. The system of claim 1, wherein the sensor is one of a plurality of sensors distributed over the crane.

13. A system, comprising:

a crane;

a sensor coupled in the crane and configured to detect an operating condition of the crane;

a crane operating condition monitor incorporated in the crane, operatively coupled to the sensor and configured for monitoring the operating condition of the crane, the crane operating condition monitor including a calculation unit and a first display unit; and an operations planner incorporated in the crane, operatively coupled to the sensor, and configured to execute at least one program for planning an operation of the crane, the operations planner further configured to execute the at least one program for redundantly monitoring the operating condition of the crane in dependence on a value detected by the sensor, the operations planner including a computer and a second display unit; wherein the crane operating condition monitor and the operations planner are further configured to exchange data with each other.

14. The system of claim 13, wherein the operations planner is further configured to store a load capacity value and a geometry file, and the computer is configured to compute an operating value of the crane based at least partly on the load capacity value and on the geometry file, and to compare the operating value computed to an operating value obtained in parallel from the crane operating condition monitor.

15. The system of claim 14, wherein the computer is further configured to provide an error signal to a crane control if crane operation values determined independently in the crane operating condition monitor and the operations planner deviate unacceptably.

16. The system of claim 13, wherein the operations planner is further configured to receive one or more setting values from the crane operating condition monitor.

17. A method for planning and monitoring operations of a crane, the method comprising:

planning an operation of the crane via an operations planner comprising a computer and a first display unit disposed in the crane;

monitoring an operating condition of the crane via a crane monitoring means comprising a calculation unit and a second display unit, also disposed in the crane; and redundantly monitoring the operating condition of the crane via the operations planner, wherein the first display unit can be switched from displaying crane planning operations to displaying the operating condition.

18. The method of claim 17, further comprising:

comparing a result of monitoring the crane operating condition via the crane monitoring means to a result of monitoring the crane operating condition via the operations planner; and generating an error message when the results of monitoring the crane operating condition differ unacceptably.

19. The method of claim 18, further comprising processing the error message in a crane control in order to do one or more of maintaining the crane in a safe condition, putting the crane in a safe condition, and limiting a dangerous movement of the crane.

* * * * *